US005365595A

United States Patent [19]

Li

[11] Patent Number: 5,365,595

[45] Date of Patent: Nov. 15, 1994

[54] SEALED MICROPHONE ASSEMBLY

[75] Inventor: Richard C. Li, Plantation, Fla.

[73] Assignee: Motorola, Inc., Schaumburg, Ill.

[21] Appl. No.: 19,800

[22] Filed: Feb. 19, 1993

[51] Int. Cl.[5] ..... H04R 25/00

[52] U.S. Cl. ..... 381/168; 381/169; 381/189; 381/91

[58] Field of Search ..... 381/168, 169, 173, 174, 381/176, 177, 179, 91, 189, 159; 455/128; 379/175; 367/141

[56] References Cited

U.S. PATENT DOCUMENTS

| | | | |
|---|---|---|---|
| 2,627,932 | 1/1947 | Vollumann et al. | 381/169 |
| 2,733,302 | 1/1956 | Geib et al. | 381/169 |
| 2,828,413 | 3/1958 | Bowers | 455/128 |
| 3,876,843 | 4/1975 | Moen | 381/168 |
| 4,570,746 | 2/1986 | Das et al. | 381/158 |
| 4,654,883 | 3/1987 | Iwata | 381/151 |
| 4,845,760 | 7/1989 | Awakowicz et al. | 381/188 |
| 5,208,868 | 5/1993 | Sapiejewski | 381/183 |

*Primary Examiner*—Curtis Kuntz
*Assistant Examiner*—Sinh Tran
*Attorney, Agent, or Firm*—Robert S. Babayi; M. Mansour Ghomeshi

[57] ABSTRACT

A sealed microphone assembly is disclosed including a microphone (120), a microphone housing (110) having a cavity (116) being resonant at an audio frequency range, and a sealing membrane (130). The sealing membrane 130 covers the cavity 116, thereby making the microphone assembly (100) fully sealed. The attenuation caused by sealing the microphone assembly (100) is compensated by the resonant characteristic of the cavity (116). The cavity (116) also includes one or more apertures (112) for creating a bandpass response.

4 Claims, 2 Drawing Sheets

SEALED MICROPHONE ASSEMBLY

TECHNICAL FIELD

This invention relates in general to the field of microphones and in particular to a microphone assembly which is sealed to prevent entry of undesired substances.

BACKGROUND

Land/mobile communication devices, such as portable and mobile two-way radios, are extensively used to provide communication capability in a variety of emergency and non-emergency situations. During an emergency, the communication devices are expected to operate flawlessly, even under severe environmental conditions. Submersibility and protection from the entry of undesired substances is an important consideration in design of submersible communication devices and for achieving highly-reliable communication during inclement weather or when the communication device is utilized at sea.

Generally, a communication device includes a housing for enclosing radio circuit assembly and subassemblies. However, one or more apertures may be formed on the exterior surfaces of the housing for allowing a user to interface with the communication device. For example, user interface apertures may be formed for positioning interface switches. More importantly, the communication device housing usually includes acoustic microphone and speaker apertures to allow transfer of acoustic energy from speaker or into microphone.

Many submersible or otherwise known waterproof communication devices already exist. Conventionally, a number of sealing means, such as pads and gaskets, are utilized for sealing the apertures of the radio housing. Gaskets seal the outer periphery of the housing while individual sealing pads seal apertures formed within the inner periphery of the housing.

A particular problem arises, however, when a microphone aperture is sealed using a sealing pad or a sealing membrane. This is because the sealing membrane may cause excessive acoustic attenuation, hindering transfer of acoustic energy into the microphone, thereby reducing the efficiency of such transfers.

Conventional approaches for preventing entry of undesired substances through the microphone aperture comprise using a long, curved acoustic pipe which extends from a microphone positioned well within the enclosure to attach to the microphone aperture disposed on the housing. In this way, the curved formation of the acoustic pipe substantially prevents entry of water and other undesired substances. The curved pipe approach, however, causes both frequency response deterioration and increased acoustic distortion. Furthermore, strictly speaking, this approach doesn't fully waterproof and seal the communication device. Therefore, there exists a need for a microphone assembly which is fully waterproof and which can be used in a communication device without increasing distortion and acoustic attenuation.

SUMMARY OF THE INVENTION

Briefly, according to the invention, a microphone assembly is provided comprising a microphone, a microphone housing having an acoustically resonant cavity within an audio frequency range, and a sealing membrane. The microphone is centrally positioned within the cavity and the sealing membrane covers the cavity to make the microphone assembly fully waterproof. In this arrangement, the acoustic cavity is formed to have an acoustically resonant response for compensating any attenuation created as a result of sealing the cavity. The acoustic cavity also has at least one selectively formed aperture for providing a bandpass acoustic response.

DETAILED DESCRIPTION OF THE PREFERRED EMBODIMENT

Figure 1:
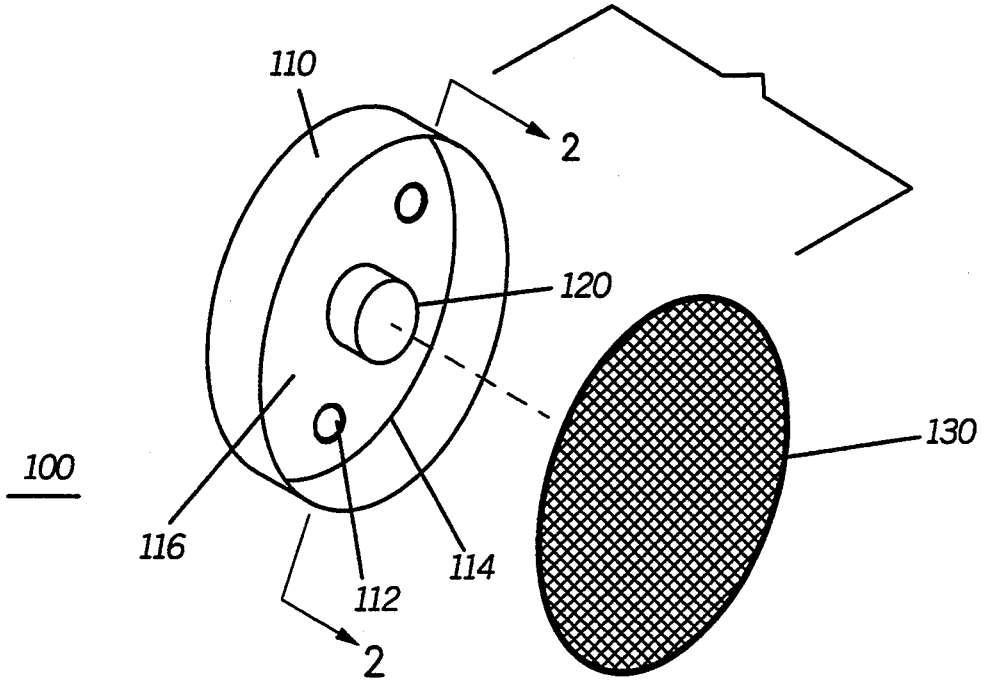
FIG. 1 is an exploded view of the microphone assembly according to the present invention.

While the specification concludes with claims defining the features of the invention that are regarded as novel, it is believed that the invention will be better understood from a consideration of the following description in conjunction with the drawing figures, in which like reference numerals are carried forward.

Referring to FIG. 1, an exploded view of the microphone assembly 100, according to the present invention, is shown. The microphone assembly 100 comprises three major elements: a microphone 120, a microphone housing 110, and a sealing membrane 130. The microphone housing 110 is formed to include a cavity 116 within which the microphone 120 is centrally positioned. The membrane 130 covers the cavity 116, thereby sealing the microphone assembly 100. The microphone 120 comprises an electric microphone, such as PRIMO EM-76 which is highly sensitive, having a fiat frequency response, low distortion, and a small size. The membrane 130 comprises a rubberized silk membrane, such as Reeves brothers type -7202 having a thickness of approximately 3 mils and a resistivity of approximately 2.3 ounce per square yard. The membrane covers the cavity in a zero tension, i.e. with no stretching, so that the device is neither a kettle drum nor a membrane vibrator.

By placing the membrane 130 over the cavity 116, an acoustic barrier is created in front of the microphone 120 which, if uncompensated, causes a sound signal generated by a user to be attenuated. According to one aspect of the present invention, the acoustic deterioration caused by the membrane 130 is compensated for by making the cavity 116 resonant at the audio frequency range within which the microphone assembly 100 operates. It is well known that the desired audio frequency range is generally between the range of 300 Hz to 3 KHz. Therefore, by shaping the cavity 116 to be resonant within this audio frequency range, the acoustic attenuation caused by covering the microphone 120 is compensated by the resonant affect of the cavity 116. The cavity 116 may be selectively shaped to be resonant in the audio frequency range such that the overall acoustic sensitivity of the microphone assembly 100 may be either above, below, or equal to the acoustic sensitivity of the microphone 120 itself. For example, the cavity 116 may be a very short cylindrical can which is acoustically shaped to provide the resonance required in the audio frequency range.

Furthermore, when communicating audio signals, it is necessary to condition the audio frequency spectrum in accordance with a predetermined specification. Indeed, in radio telecommunication, it is necessary, under the rules promulgated by the FCC, to limit the audio signals to a frequency range of 300 Hz to 3 KHz. Such requirements are accomplished by providing a bandpass filter with a bandwidth which conforms to this requirement. According to the FCC requirement, the frequency response below 300 Hz must be suppressed or pre-emphasized as much as possible. Also, the frequency response above 3 KHz must be de-emphasized with 6 dB/octave to 12 dB/octave depending on the operating band. In some conventional approaches, the electrical audio signal provided by the microphone is filtered by a passive or active audio filter having a response commensurate with the above requirement. However, because relative bandwidth, i.e., the ratio of filter bandwidth-to-center frequency, is very high that is over 200%, electrical implementation of such a filter is substantially difficult, especially in frequency spectrum where frequencies are below 300 Hz. Accordingly, the present invention contemplates producing the required audio bandpass response acoustically as opposed to electrically by means of the microphone assembly 100.

In the microphone assembly 100, the acoustic frequency response is aligned by providing one or more apertures on the cavity 116. As illustrated, the microphone housing 110 includes a back surface 114 encompassing a portion of the cavity 116 upon which two symmetrically positioned apertures 112 are formed. As described later in detail, the apertures 112 create a bandpass acoustic response within the microphone assembly 100, such that the presented sound signal is acoustically filtered in accordance with this response.

Figure 2:
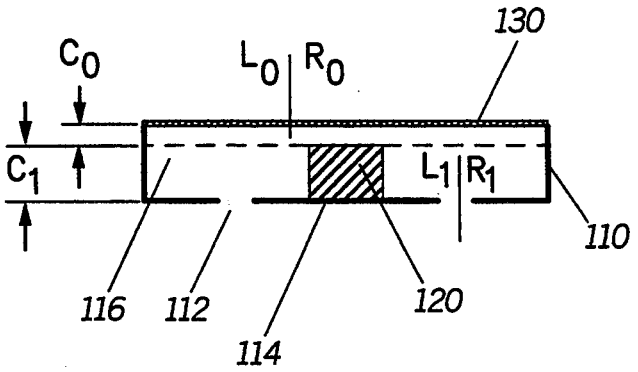
FIG. 2 is a cross-sectional view of the microphone assembly taken along line 2—2 of FIG. 1.

Referring to FIG. 2, the cross-sectional view of the microphone assembly 100 taken along lines 2—2 is shown. The cross-sectional view is depicted to illustrate the principles which create the bandpass frequency response of the present invention. Before hand, it should be noted that acoustical equivalent of electrical capacitance is known as "compliance," which comprises an enclosed volume confined between rigid planes. Also, acoustical equivalent of electrical inductance is known as "inertance," which comprises an aperture through which medium particles may be moved in phase by a sound pressure. Finally, electrical resistance is equivalent to acoustical resistance, comprising barriers which hinder acoustic waves.

With this background, it may be appreciated that the membrane 130 may be characterized as having an inertance of $L_o$ corresponding to moving inertia of the membrane 130, and a resistance of $R_o$ corresponding to the acoustical barrier presented by the membrane 130. Furthermore, the acoustic cavity 116 may be characterized as having a compliance $C_o$ corresponding to the volume between the membrane 130 and the extended front plane of the microphone and another compliance $C_1$ corresponding to the volume between the extended front plane of the microphone and its backside 114. And, finally, the apertures 112, as disposed on the back side 114, may be represented as an inertance $L_1$ and as a resistance $R_1$.

Figure 3:
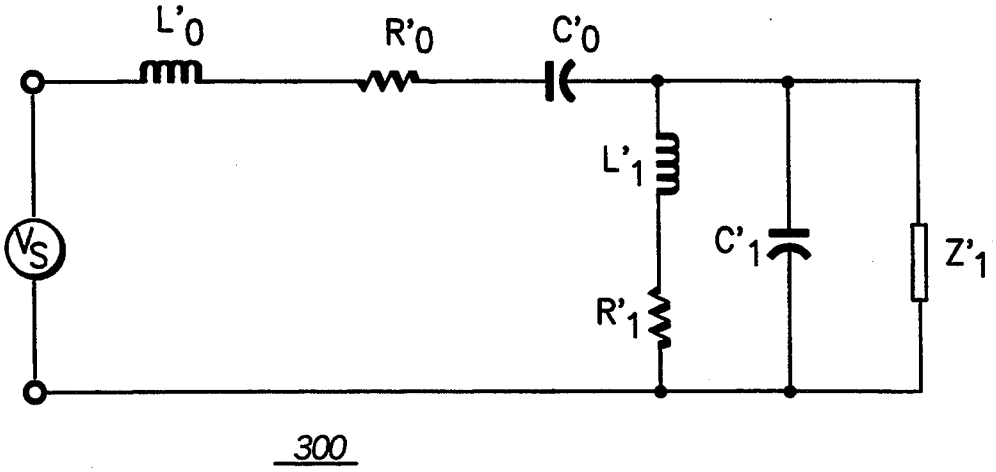
FIG. 3 is an electrically equivalent representation of the cross-sectional view of FIG. 2.

Referring to FIG. 3, an electrically equivalent circuit 300 is shown, representing the microphone assembly 100. The membrane 130 is represented by a series network comprising $L'_o$, $R'_o$. The cavity 116 is represented as a series capacitor $C'_o$ and as a shunted capacitor $C'_1$ and the apertures 112 and the backside 114 are represented by the shunted inductor $L'_1$ and resistor $R'_1$. The acoustical characteristic of the assembly 100 without the above elements is represented by an impedance $Z_1$. It may be appreciated that the electrically equivalent circuit 300 comprises a circuit having a bandpass response as is well known in the art. The bandpass response is provided because of the shunted inductance $L'_1$ and the resistance $R'_1$ which represent the apertures 112. Under this analysis, it may be appreciated that without the apertures 112, the microphone assembly 100 produces a lowpass response to the presented sound signal without pre-emphasis response when the frequency is below 300 Hz. Therefore, by adjusting the number and/or the diameter of the apertures 112, the entire acoustical frequency response of the microphone assembly 100 may be adjusted to accommodate a desired bandpass acoustical response. The acoustical response is shifted towards lower frequency as the diameter of the aperture is reduced or, alternatively, when the number of apertures are decreased. On the contrary, the acoustical response is shifted towards the higher frequency if the diameter of the apertures is enlarged or when the number of apertures are increased.

Figure 4:
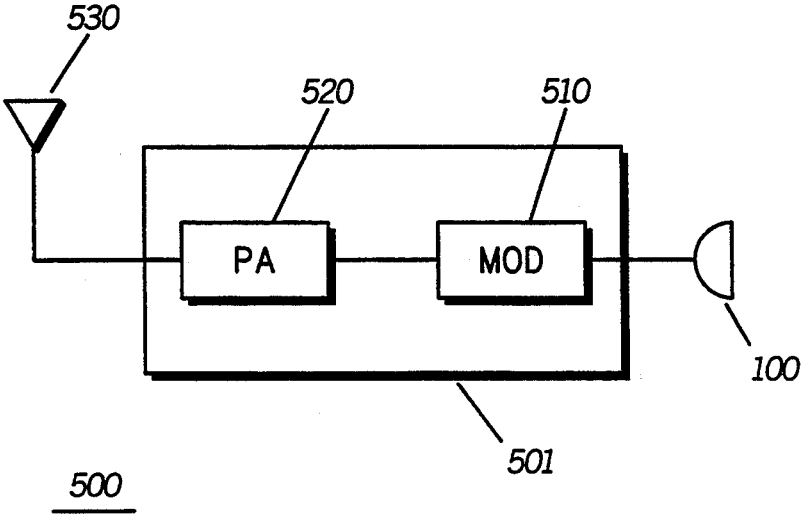
FIG. 4 is a block diagram of a radio which uses the microphone assembly of the present invention.

Referring to FIG. 4, a block diagram of a radio 500 for communicating a communication signal is shown to include the microphone assembly 100 of the present invention coupled to a transmitter 501. The microphone assembly 100 creates an audio signal having audio frequency characteristics in accordance with its acoustical response. The audio signal is applied to a well-known modulator 510 which modulates it according to appropriate modulation techniques, such as frequency modulation (FM). The output of the modulator 510 is applied to a well-known power amplifier 520 which amplifies the modulated signal for transmission. The output of the power amplifier 520 is applied to an antenna 530 which causes the audio modulated- and amplified- transmission signal to be radiated.

From the foregoing description it is apparent that the microphone assembly of the present invention, in addition to providing a sealed assembly, also includes acoustic means for conditioning response of a sound signal, thereby facilitating electrical signal processing of the audio signal. As such, the bandpass feature provided by the microphone assembly of the present invention significantly simplifies the electrical design of the modulator circuit that may be used in a radio application. This feature provides excellent pre-emphasis and de-emphasis frequency response which are required under the specification set forth by the FCC.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A waterproof microphone assembly for operating within an audio frequency range, comprising:

a microphone having a sensitivity;

a microphone housing including (a) an acoustically resonant cavity within the audio frequency range, wherein said acoustically resonant cavity is formed to include a backside upon which a microphone is centrally positioned, (b) a first selectively shaped aperture for producing an acoustic bandpass response within the audio frequency range and (c) a second selectively shaped aperture, wherein said first selectively shaped aperture and said second selectively shaped aperture are formed on said backside, and said first selectively shaped aperture and said second selectively shaped aperture are being symmetrically positioned with respect to said microphone; and a sealing membrane covering said acoustically resonant cavity to render the microphone assembly waterproof while substantially maintaining the sensitivity of the microphone.

2. The microphone assembly of claim 1, wherein said acoustic bandpass response has a bandwidth within 300 Hz to 3 KHz range.

3. A radio comprising:

a transmitter for transmitting a communication signal including a modulator for modulating an audio signal within an audio frequency range;

a waterproof microphone assembly for operating within an audio frequency range, comprising:

a microphone having a sensitivity;

a microphone housing including (a) an acoustically resonant cavity within the audio frequency range, wherein said acoustically resonant cavity is formed to include a backside upon which a microphone is centrally positioned, (b) a first selectively shaped aperture for producing an acoustic bandpass response within the audio frequency range and (c) a second selectively shaped aperture, wherein said first selectively shaped aperture and said second selectively shaped aperture are formed on said backside, and said first selectively shaped aperture and said second selectively shaped aperture are being symmetrically positioned with respect to said microphone; and a sealing membrane covering said acoustically resonant cavity to render the microphone assembly waterproof while substantially maintaining the sensitivity of the microphone.

4. The microphone assembly of claim 3, wherein said acoustic bandpass response has a bandwidth within 300 Hz to 3 KHz range.

* * * * *